US009565903B2

(12) United States Patent
Tempesta

(10) Patent No.: US 9,565,903 B2
(45) **Date of Patent: *Feb. 14, 2017**

(54) CLOSURE SYSTEM

(71) Applicant: NIKE, Inc., Beaverton, OR (US)

(72) Inventor: Laura Tempesta, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 177 days.

This patent is subject to a terminal disclaimer.

(21) Appl. No.: 14/475,829

(22) Filed: Sep. 3, 2014

(65) Prior Publication Data

US 2014/0366338 A1 Dec. 18, 2014

Related U.S. Application Data

(63) Continuation of application No. 13/154,129, filed on Jun. 6, 2011, now Pat. No. 8,826,499.

(51) Int. Cl.

| | |
|---|---|
| ***A44B 19/02*** | (2006.01) |
| ***B65D 33/25*** | (2006.01) |
| ***A44B 19/26*** | (2006.01) |
| ***B65D 33/28*** | (2006.01) |
| *A44B 19/16* | (2006.01) |

(52) U.S. Cl.

CPC ..... *A44B 19/02* (2013.01); *A44B 19/267* (2013.01); *B65D 33/25* (2013.01); *B65D 33/28* (2013.01); *A44B 19/16* (2013.01); *Y10T 24/2536* (2015.01); *Y10T 24/2545* (2015.01); *Y10T 24/45162* (2015.01)

(58) Field of Classification Search

CPC ... A44B 19/02267; A44B 19/16; B65D 33/25; B65D 33/28; Y10T 24/2545; Y10T 24/2536; Y10T 24/45162

See application file for complete search history.

(56) References Cited

U.S. PATENT DOCUMENTS

| | | | |
|---|---|---|---|
| 3,192,589 | A | 7/1965 | Pearson |
| 3,266,113 | A | 8/1966 | Flanagan, Jr. |

(Continued)

FOREIGN PATENT DOCUMENTS

| | | | |
|---|---|---|---|
| JP | 2009001329 | A | 1/2009 |
| JP | 2010168098 | A | 8/2010 |

(Continued)

OTHER PUBLICATIONS

International Search Report and Written Opinion mailed Aug. 27, 2012 in PCT Application No. PCT/US2012/041130, 10 pages.

(Continued)

*Primary Examiner* — Robert J Sandy
(74) *Attorney, Agent, or Firm* — Shook, Hardy & Bacon L.L.P.

(57) ABSTRACT

A closure or fastener is provided for apparel, shoes, equipment, and other applications. The closure may have a female component having a receiving area and a male component having a locking portion. Either or both the male component and female component may have a notched appearance to provide additional flexibility and comfort to the closure. Flanges on the male components and the female components may facilitate off-registration engagement of the closure system. Textures present or absent in the closure system may permit or prevent sliding by the male components and female components when the closure is engaged.

18 Claims, 10 Drawing Sheets

(56) References Cited

U.S. PATENT DOCUMENTS

| | | | | |
|---|---|---|---|---|
| 4,290,174 | A | 9/1981 | Kalleberg | |
| 4,778,282 | A | 10/1988 | Borchardt et al. | |
| 4,854,017 | A | 8/1989 | Kamp | |
| 5,138,750 | A | 8/1992 | Gundlach et al. | |
| 5,140,727 | A | 8/1992 | Dais et al. | |
| 5,212,853 | A | 5/1993 | Kaneko | |
| 5,273,511 | A | 12/1993 | Boeckman et al. | |
| 5,398,387 | A | 3/1995 | Torigoe et al. | |
| 5,647,100 | A * | 7/1997 | Porchia ..... | B65D 33/2508 24/30.5 R |
| 5,794,315 | A | 8/1998 | Crabtree et al. | |
| 5,797,170 | A | 8/1998 | Akeno | |
| 5,933,927 | A | 8/1999 | Miller et al. | |
| 5,934,806 | A | 8/1999 | Tomic et al. | |
| 5,955,160 | A | 9/1999 | Tanaka et al. | |
| 6,209,177 | B1 | 4/2001 | Murasaki | |
| 6,243,927 | B1 | 6/2001 | Matsushima | |
| 6,293,701 | B1 | 9/2001 | Tomic | |
| 6,367,128 | B1 | 4/2002 | Galkiewicz et al. | |
| 6,481,064 | B2 | 11/2002 | Kawahara | |
| 7,036,190 | B2 | 5/2006 | Demarest | |
| 7,185,401 | B2 | 3/2007 | Ausen et al. | |
| 2001/0044991 | A1 | 11/2001 | Graves | |
| 2002/0116748 | A1 | 8/2002 | Lipsett et al. | |
| 2004/0234171 | A1 | 11/2004 | Dais et al. | |
| 2005/0235467 | A1 | 10/2005 | Brochardt et al. | |
| 2012/0033899 | A1 | 2/2012 | Takamura | |

FOREIGN PATENT DOCUMENTS

| | | | |
|---|---|---|---|
| WO | 9831597 | A1 | 7/1998 |
| WO | 201011967 | A1 | 10/2010 |

OTHER PUBLICATIONS

International Preliminary Report on Patentability dated Dec. 27, 2013 in PCT Application No. PCT/US2012/041130, 9 pages.

Non-Final Office Action mailed Jan. 14, 2014 in U.S. Appl. No. 13/154,129, 9 pages.

Notice of Allowance mailed May 6, 2014 in U.S. Appl. No. 13/154,129, 6 pages.

European Extended Search Report dated Oct. 14, 2015 in Application No. 12796904.6, 6 pages.

* cited by examiner

CLOSURE SYSTEM

CROSS REFERENCE TO RELATED APPLICATIONS

This application is a continuation of U.S. Non-provisional patent application Ser. No. 13/154,129, filed Jun. 6, 2011, now U.S. Pat. No. 8,826,499, entitled "Closure System," the entirety of which is incorporated by reference herein.

FIELD OF THE INVENTION

The present disclosure relates to fasteners for clothing and other apparel items.

BACKGROUND OF THE INVENTION

Fasteners for clothing include zippers, buttons, hook-and-eye fasteners, snap closures, and hook-and-loop fasteners. While these conventional fasteners are adequate for some applications, they have physical limitations that reduce their usefulness and applicability to some clothing and apparel. On the other hand, clothing without fasteners, for example pants with an elastic waistband, relies on the elasticity of the clothing but may sacrifice fit and durability as a result.

SUMMARY OF THE INVENTION

Accordingly, a closure system for apparel and non-apparel items is provided for improved fit comfort, convenience, and functionality.

One example of a closure may comprise a male component comprising a first flange and a plurality of male projections arranged along a first line. Each male projection may comprise a stem having a first base and a first head connecting with the flange at the first base of the stem, and a locking portion, having a second base and a second head, the second base being wider than the stem and the second head, connecting with the first head at the second base. The closure may also comprise a female component comprising a second flange and plurality of female projections arranged along a second line. The interrelationship of flanges on the male components, and the female components permits the closure system to be engaged even if the male components and the female components are slightly off-registration with each other, thereby facilitating use of the closure system. Each of the female projections may comprise a first female stem and a second female stem arranged on opposite sides of the second line, forming a receiving area to fit the locking portion. The first female stem may further comprise a first hooked portion and the second female stem may comprise a second hooked portion, such that the first hooked portion and the second hooked portion face each other to fit the locking portion.

In addition, the plurality of male projections of the male component may comprise a notch in each male projection along the first line extending from the second head of the locking portion through the stem to the first base. The plurality of male projections of the male component may be hooked at the second based of the locking portion to fit the receiving area. The receiving area may comprise an inner surface, and the locking portion may comprise an outer surface. In one example, the outer surface may have a texture that grips the inner surface of the receiving area. In another example, the inner surface may have a texture that grips the outer surface of the locking portion. In another example, the inner surface and the outer surface may be substantially smooth such that when the locking portion may be within the receiving area, the male component and the female component may slide while fastened.

One example of a fastener may comprise a male component comprising a first flange and a plurality of projections arranged on a first line. Each projection may comprise a stem having a first base and a first head, connecting with the flange at the first base of the stem, and a locking portion, having a second base and a second head, the second base being wider than the stem and the second head, connecting with the first head at the second base. The fastener also may comprise a female component comprising a second flange and a pair of rails comprising a first rail and a second rail arranged on opposite sides of a second line. The pair of rails each may have a hooked portion extending towards each other forming a receiving area of the locking portion of the male component.

Additionally, the pair of rails of the female component may comprise a plurality of notches through the pair of rails to the second flange and perpendicular to the second line. The plurality of projections of the male component may comprise a notch in each male projection along the first line extending from the second head of the locking portion through the stem to the first base. The receiving area may comprise an inner surface and the locking portion may comprise an outer surface. The outer surface may have a texture that grips the inner surface of the receiving area. The inner surface of the receiving area may have a texture that grips the outer surface of the locking portion. The outer surface of the locking portion and the inner surface of the receiving area may be substantially smooth such that when the locking portion may be within the receiving area, the male component and the female component may slide while fastened.

In an additional example, the fastener may comprise a male track comprising a first flange and a first rail arranged along a first line. The first rail may extend substantially the length of the first line and may have a first base and a first head, connecting with the flange at the first base of the first rail. The first rail further may comprise a locking portion having a second base and a second head. The second head may be wider than the first base and the second head and connects with the first head at the second base. The female track of the fastener may comprise a second flange and a pair of rails comprising a second rail and a third rail arranged on opposite sides of a second line. The pair of rails may have a pair of hooks projections extending towards each other forming a receiving area for the locking portion of the first rail.

In addition, the pair of rails of the female flange of the fastener may comprise a plurality of notches perpendicular to the second line and through the pair of rails to the second flange. The first rail of the male track may comprise a plurality of first notches perpendicular to the first line and through the first rail to the first flange. The first rail of the male track may comprise a plurality of second notches perpendicular to the first notches along the first line and through the first rail to the first flange. The pair of rails of the female track may comprise a plurality of notches perpendicular to the second line and through the pair of rails to the second flange. The first rail of the male track may comprise a hooked portion of the second base to fit the receiving area of the female track. The receiving area of the fastener may have an inner surface. The locking portion of the fastener may have an outer surface. The outer surface of the locking portion may have a texture that grips the inner surface of the receiving area. The inner surface of the receiving area may have a texture that grips the outer surface of the locking portion. In another example, the outer surface of the locking portion and the inner surface of the receiving area may be substantially smooth such that when the locking portion may be within the receiving area, the male track and the female track may slide while fastened.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

BRIEF DESCRIPTION OF THE DRAWING

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE INVENTION

The track snap closure described herein may be employed to hold together seams edges or surface of apparel or clothing applications. The track snap closure provides a quick and simple fastening means that does not require perfect registration between components of the male track and components of the female track. Moreover, the track snap closure provides improves comfort and aesthetics due to the flexibility and low profile of the male track and female track.

Generally, the spacing and relative dimensions illustrated in the figures may not be to scale. Any proportion of spacing and track snap closure component dimension may be contemplated to fit the track snap closure application desired. Also, generally, FIGS. 1-14 illustrate examples of a track snap closure having sharp edged portions or angled edges for the male and female track components. However, it will be understood that the components of the male and female track may also have rounded portions or curved/blunted edges, which may be employed to prevent snagging and/or increase robustness of the components.

Figure 1:
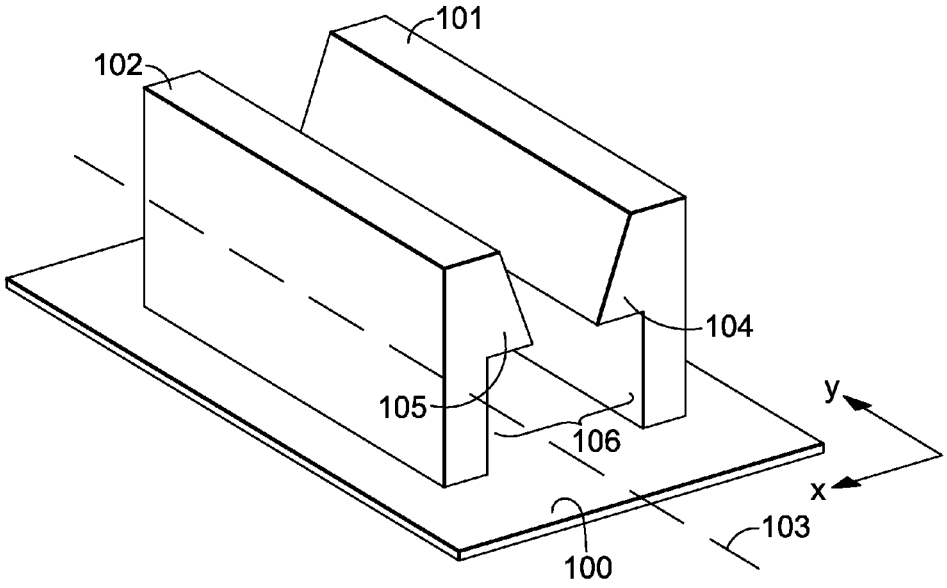
FIG. 1 is an illustration of a female component or female track.

FIG. 1 provides one example of a female component or track of a track snap closure. The female component may have a flange 100 and a pair of rails 101, 102 arranged on opposite sides of a line 103. The pair of rails 101, 102 may have hooked projections 104, 105 that extend toward each other to form a receiving area 106. The flange 100 may be constructed separately or integrally with the pair of rails 101, 102 and may be made of the same or different material. For example, the entire female component or track may be injected molded of one polymer resin. In another example, the flange 100 may be made of a plastic that may be more flexible and the pair of rails 101, 102 may be made of a plastic that may be more wear-resistant.

Figure 2:
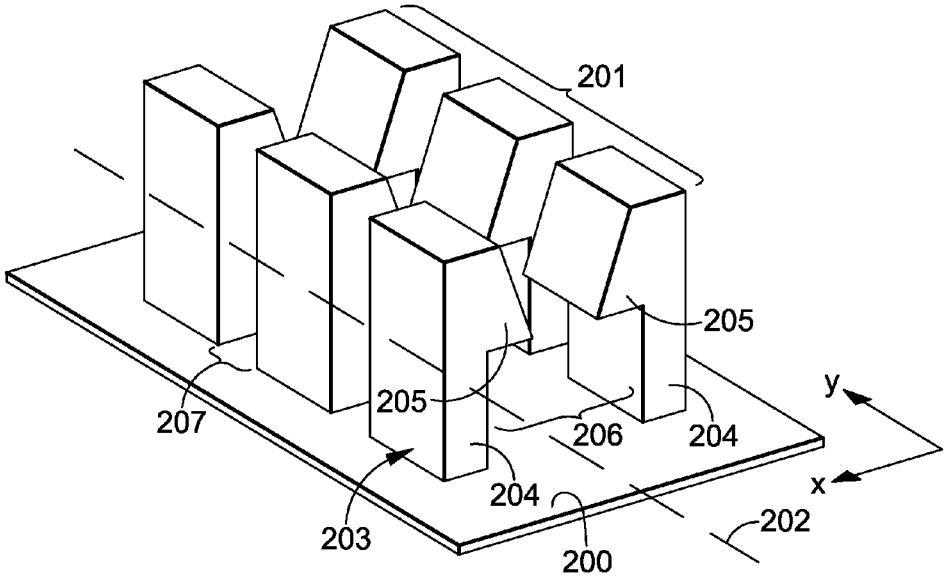
FIG. 2 is an illustration of a female component or female track.

FIG. 2 may be another example of a female component or track of a track snap closure. The female component may have a flange 200 and a plurality of female projections 201 arranged along a line 202. Each female projection 203 may have a pair of stems 204 including a hooked portion 205 of each stem facing each other to form a receiving area 206. Alternately, the female component or track may be a flange 200 and a pair of rails 201 arranged on opposite sides of a line. The pair of rails may have a hooked portion 205 facing each other to form a receiving area 206. The female component or track may have a plurality of notches 207 perpendicular to the line and through the pair of rails. The plurality of notches may extend completely through the rails to the flange or may only extend partially through the rails. Alternately, the female component may be a plurality of female projections arranged along a line. Each female projection may form a receiving area to fit a locking portion of a male component or projection. The receiving area may have a hooked appearance or may be another geometry depending on the need of the track snap closure application. The spacing illustrated may be arbitrary and any spacing between the projections may be contemplated to meet the needs of the track snap closure. The flange may be constructed separately or integrally with the pair of rails and may be made of the same or different material.

Figure 3:
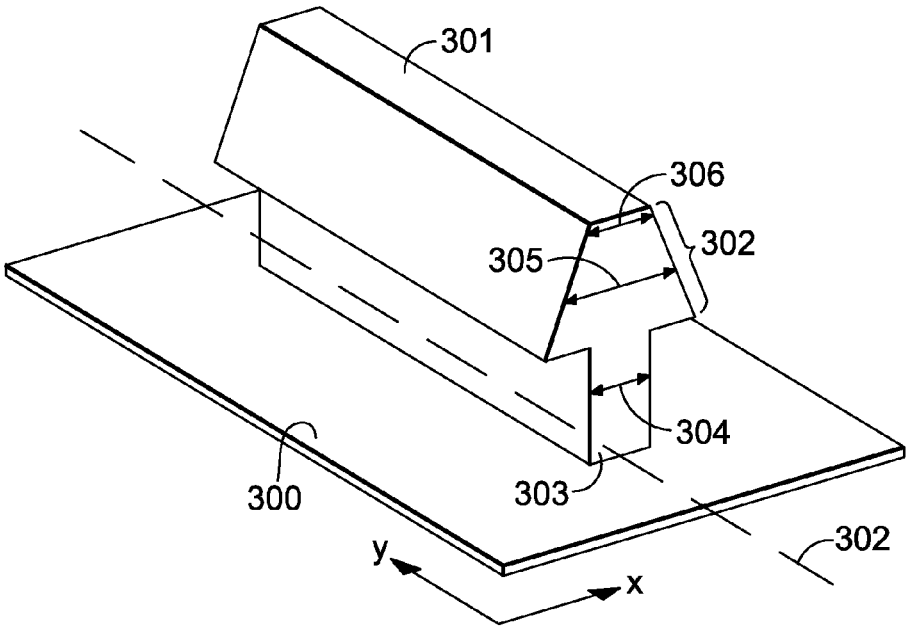
FIG. 3 is an illustration of a male component or male track.

FIG. 3 may be one example of a male component or track of a track snap closure. The male component may comprise a flange 300 and a rail 301 arranged along a line 302. The rail may have a first base 303 and a first head 304 connecting with the flange 300 at the base 303. The rail also may comprise a locking portion 302 having a second base 305 and a second head 306, the second base 305 being wider than the first base 303 and the second head 306, connecting with the first head 304 at the second base. The locking portion 307 of the male component may snap into the receiving area of the female component or track. As shown in FIG. 3, the locking portion 307 may have a hooked portion to secure the locking portion within the receiving area. Alternately, the locking portion may be flat at the second base to provide a slideable fastening. The locking portion of the male component and the receiving area of the female component may be molded or machined to complement each other. The flange may be constructed separately or integrally with the rail and may be made of the same or different material.

Figure 4:
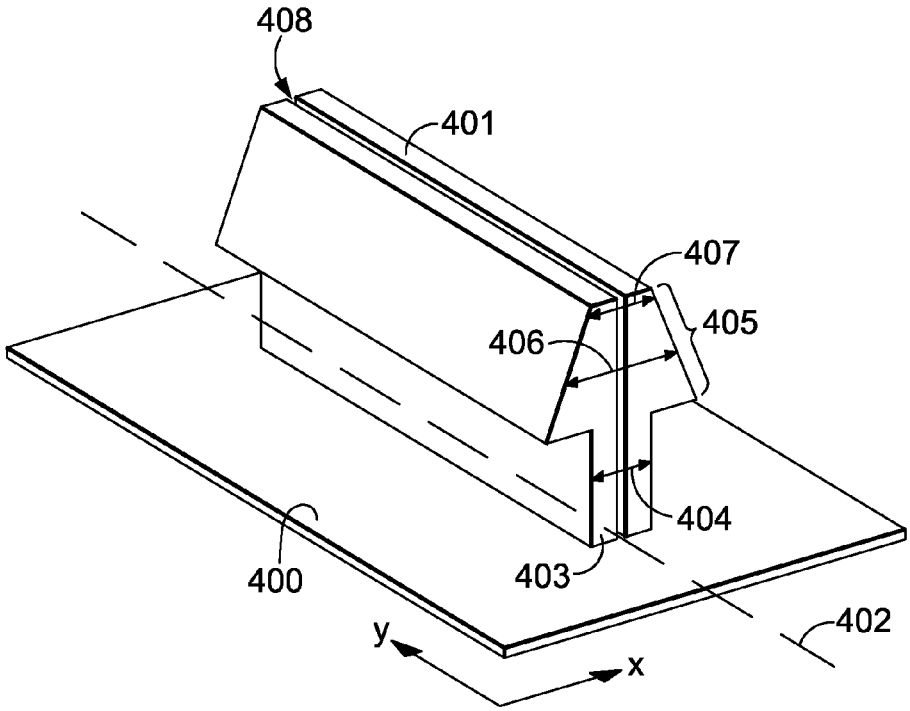
FIG. 4 is an illustration of a male component or male track.

FIG. 4 may be another example of a male component or track of a track snap closure. The male component may comprise a flange 400 and a rail 401 arranged along a line 402. The rail 401 may have a first base 403 and a first head 404 connecting with the flange 400 at the base 403. The rail 401 also may comprise a locking portion 405 having a second base 406 and a second head 407, the second base 406 being wider than the first base 404 and the second head 407, connecting with the first head at the second base. The locking portion 405 of the male component snaps into the receiving area of the female component or track. The rail also may comprise a notch 408 extending down the line 402 or central line of the rail. For example, the notch may divide the rail in half to form two rails. The notch may extend through the rail to the flange or may extend partially through the rail. In another example, a male component may comprise a flange and two rails arranged closely along a line. The space between two rails may be substantially smaller than the width of either rail. Each rail may have a base and a head connecting with the flange at the base. The two rails together form a locking portion having a second base and a second head. The base of the locking portion being wider at the base than at the second head. The flange may be constructed separately or integrally with the rail and may be made of the same or different material.

Figure 5:
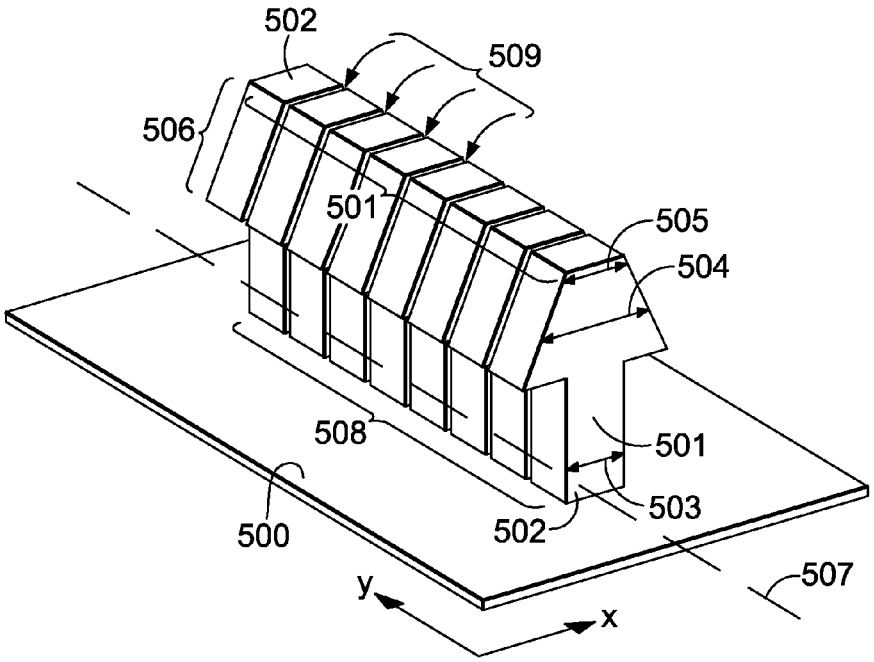
FIG. 5 is an illustration of a male component or male track.

FIG. 5 may be another example of a male component or track of a track snap closure. In FIG. 5, one example of a male component may comprise a flange 500 and a plurality of male projections 501 arranged substantially along a line 507. Each male projection 501 may comprise a stem with a first base 502 and a first head 503. Each male projection connects with the flange 500 at the first base 502. In addition, each male projection 501 may have a locking portion 506 having a second base 504 wider than the first base 502 of the stem and wider than the head of the locking portion 506. In another example, a male component may comprise a flange 500 and a rail 508 arranged along a line 507. The rail may have a base and a head connecting with the flange at the base. The rail also may comprise a locking portion having a second base 504 and a second head 505, the second base 504 being wider than the first base 502 and the second head 505, connecting with the first head 503 at the second base 504. The locking portion of the male component snaps into the receiving area of the female component or track. The rail also may comprise a plurality of notches 509 perpendicular to the rail or line 507 to divide the rail or track into sections or individual male projections. The notches may extend through the rail to the flange or may extend partially through the rail. The flange may be constructed separately or integrally with the rail and may be made of the same or different material. The locking portion may have a hooked appearance or may be another geometry depending on the need of the track snap closure application. The spacing of the sections or projections illustrated may be arbitrary and any spacing between the projections may be contemplated to meet the needs of the track snap closure.

Figure 6:
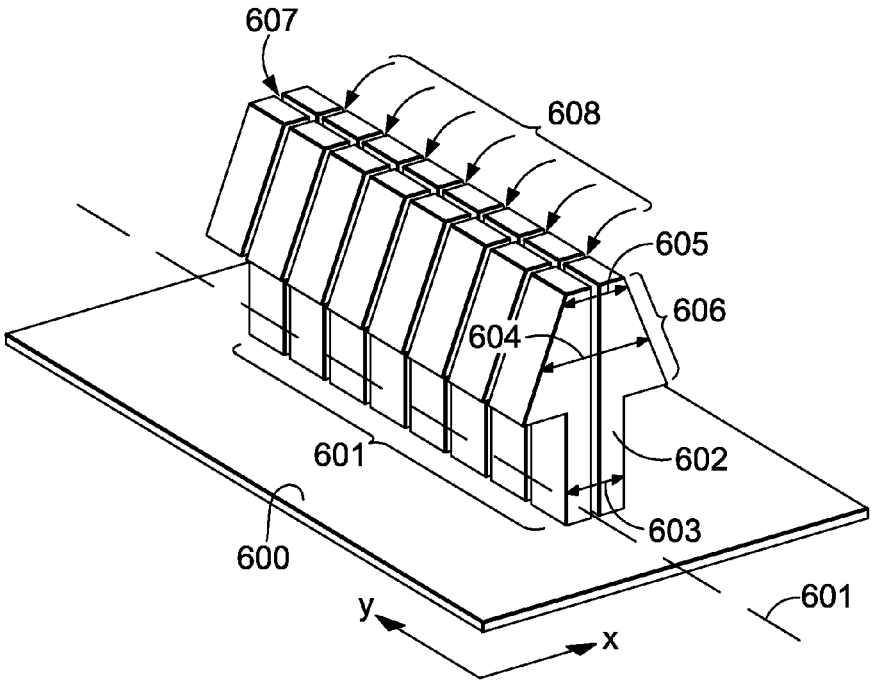
FIG. 6 is an illustration of a male component or male track.

FIG. 6 may be another example of a male component or track of a track snap closure. The male component may comprise a flange 600 and a rail 601 arranged along a line. The rail 601 may have a base 602 and a head 603 connecting with the flange at the base. The rail 601 also may comprise a locking portion 606 having a second base 604 and a second head 605, the second base 604 being wider than the first base 602 and the second head 605, connecting with the first head 603 at the second base 604. The locking portion 606 of the male component snaps into the receiving area of the female component or track. The rail 601 also may comprise a notch 607 extending down the line or central line of the rail. For example, the notch 607 may divide the rail in half to form two rails. The notch may extend through the rail to the flange or may extend partially through the rail. The rail also may comprise a plurality of notches 608 perpendicular to the rail or the notch 607 to divide the rail or track into sections or individual male projections. The notches may extend through the rail to the flange or may extend partially through the rail. Another example of a male component may comprise a flange and a plurality of male projections arranged along a line. Each male projection may comprise a stem with a first base and a first head. Each male projection connects with the flange at the first base. In addition, each male projection may have a locking portion having a second base wider than the stem and wider than the head of the locking portion. Each male projection may have a notch perpendicular to the line: the notch may extend through the projection to the flange or may extend partially through the projection. The flange may be constructed separately or integrally with the rail and may be made of the same or different material. The locking portion may have a hooked appearance or may be another geometry depending on the need of the track snap closure application. The spacing of the sections or projections illustrated may be arbitrary and any spacing between the projections may be contemplated to meet the needs of the track snap closure.

Figure 7A:
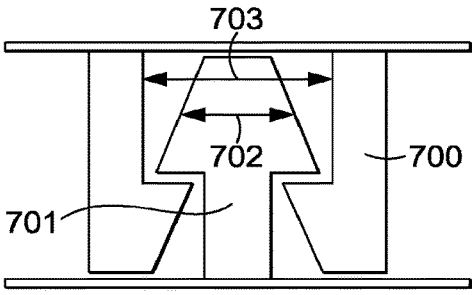
FIG. 7A-B is an illustration of a fastened male component and female component.
Figure 7B:
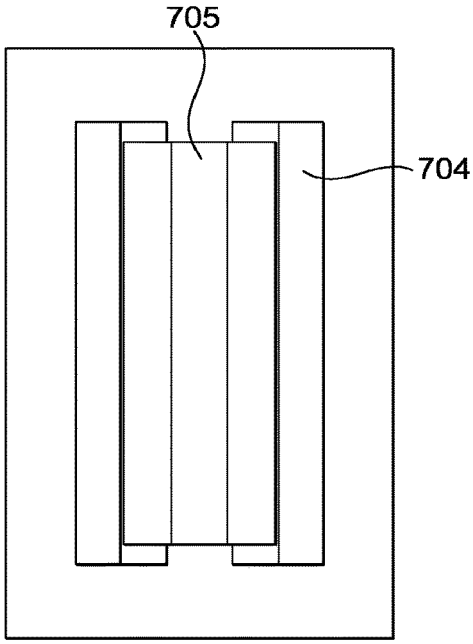

FIG. 7A-B illustrates one example of a track snap closure with the male component 701 or track and the female component 700 or track assembled. As shown in FIG. 7A, the receiving area 703 of the female component and the locking component 702 of the male component fit together or snap together. FIG. 7B illustrates a female component 704 such as the example in FIG. 1 and the male component 705 similar to the example in FIG. 3. The two continuous tracks may be fastened by snapping together or by sliding the male component 705 down the female track 704. Generally, the male component and the female component may be molded or machined of the same or different material.

Figure 8A:
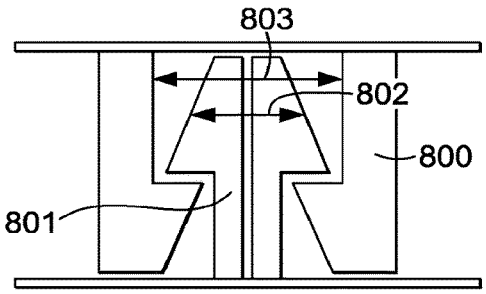
FIG. 8A-B is an illustration of a fastened male component and female component.
Figure 8B:
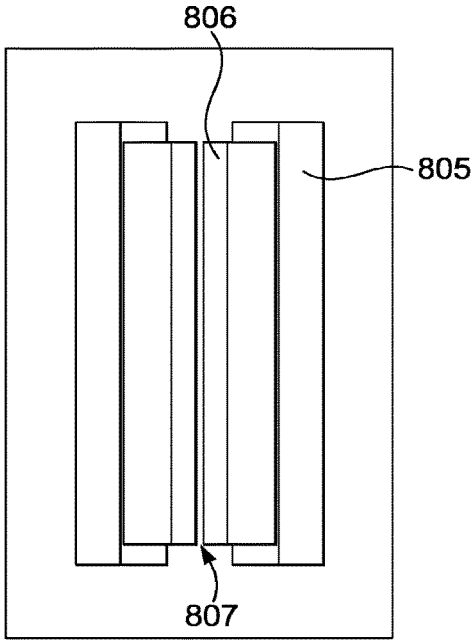

FIG. 8A-B illustrates another example of a track snap closure with the male component 801 or track and the female component 800 or track assembled. FIG. 8A-B illustrates a male component similar to FIG. 4 and a female component similar to FIG. 1. As shown in FIG. 8A, the receiving area 803 of the female component and the locking component 802 of the male component fit together or snap together. The two tracks may be fastened either by snapping the male component 806 into the female component 805 or by sliding the male component 806 down the female track 805. The notch in the male component may provide some "give" in the snap closure.

Figure 9A:
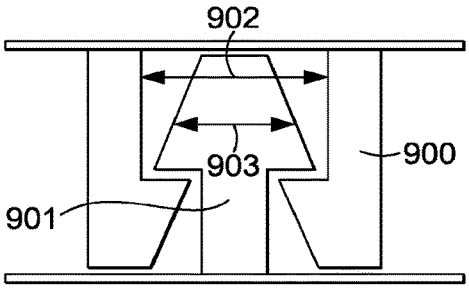
FIG. 9A-B is an illustration of a fastened male component and female component.
Figure 9B:
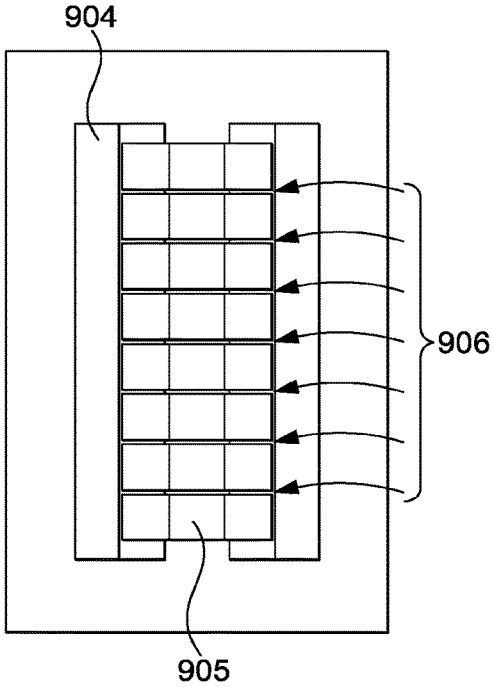

FIG. 9A-B illustrates another example of a track snap closure with the male component or track and the female component or track assembled. FIG. 9A-B illustrates a male component similar to FIG. 5 and a female component similar to FIG. 1. As shown in FIG. 9A, the receiving area 902 of the female component 900 and the locking component 903 of the male component 901 fit together or snap together. The two tracks may be fastened either by snapping the male component 905 into the female component 904 or may be fastened by snapping individual male projections 906 or sections of the male component 905 into the female component 904. The sectioned or notched male component may provide additional flexibility to the track snap closure. For example, it would be possible to form the male component of the track snap closure with a harder plastic without sacrificing comfort and flexibility.

Figure 10A:
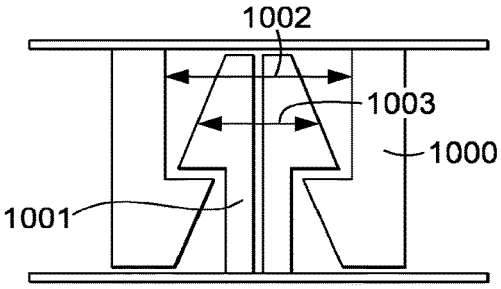
FIG. 10A-B is an illustration of a fastened male component and female component.
Figure 10B:
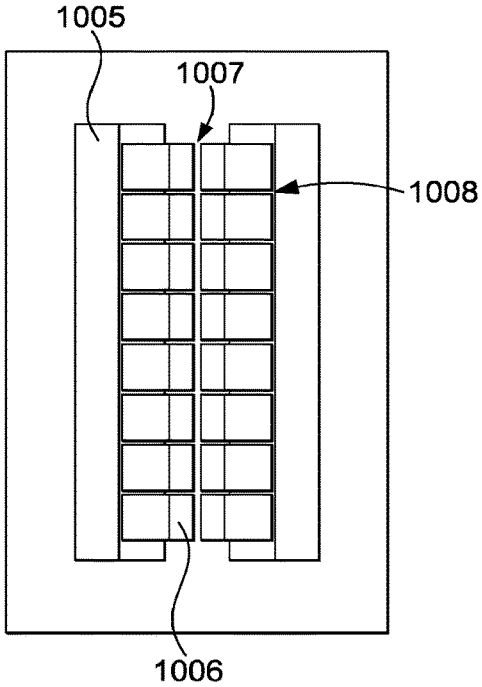

FIG. 10A-B illustrates another example of a track snap closure with the male component or track and the female component or track assembled. FIG. 10A-B illustrates a male component similar to FIG. 6 and a female component similar to FIG. 1. As shown in FIG. 10A, the receiving area 1002 of the female component 1000 and the locking component 1003 of the male component 1001 fit together or snap together. The two tracks may be fastened either by snapping the male component 1006 into the female component 1005 or may be fastened by snapping individual male projections or sections of the male component 1006 into the female component 1005. The sectioned or notched male component 1006 may provide additional flexibility to the track snap closure.

Figure 11A:
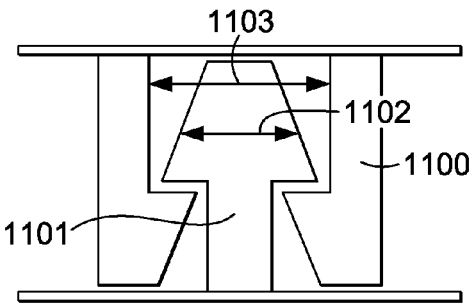
FIG. 11A-B is an illustration of a fastened male component and female component.
Figure 11B:
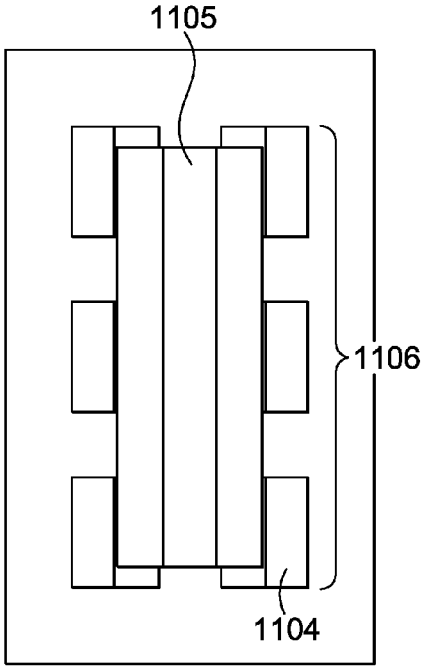

FIG. 11A-B illustrates another example of a track snap closure with the male component or track and the female component or track assembled. FIG. 11A-B illustrates a male component similar to FIG. 3 and a female component similar to FIG. 2. In the configuration illustrated in FIG. 11B, the female component may be notched into individual female projections. As shown in FIG. 11A, the receiving area of the female component and the locking component of the male component fit together or snap together. The two tracks may be fastened either by snapping the male component into the entire female component or by snapping the male component into the individual female projections.

Figure 12A:
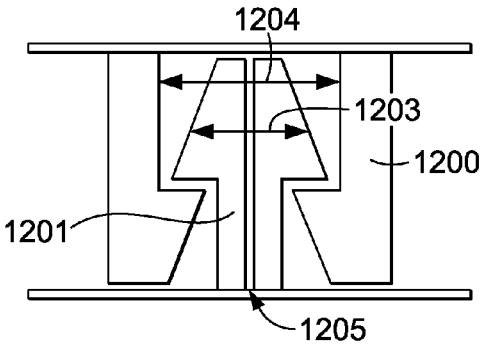
FIG. 12A-B is an illustration of a fastened male component and female component.
Figure 12B:
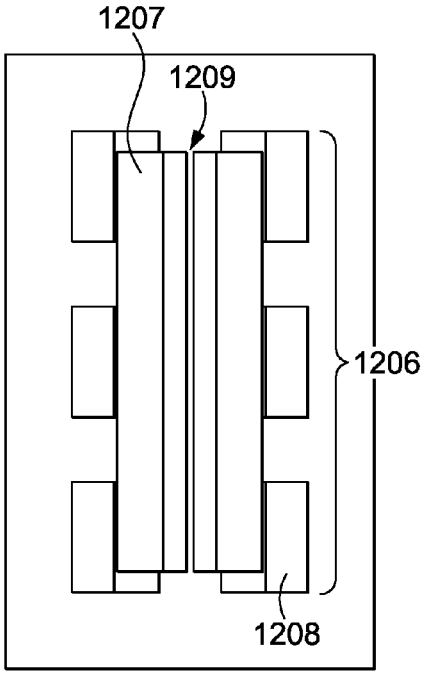

FIG. 12A-B illustrates another example of a track snap closure with the male component or track and the female component or track assembled. FIG. 12A-B illustrates a male component similar to FIG. 4 and a female component similar to FIG. 2. In the configuration illustrated in FIG. 12B, the female component 1206 may be notched into individual female projections 1208. The male component 1207 may have a central notch 1209 along the length of the component. As shown in FIG. 12A, the receiving area 1204 of the female component 1200 and the locking component 1203 of the male component 1201 fit together or snap together. The two tracks may be fastened either by snapping the male component 1207 into the female component 1206 simultaneously or by snapping the male component 1207 along the individual projections 1208 of the female component 1206. The notch 1205 in the male component may provide some "give" in the snap closure.

Figure 13A:
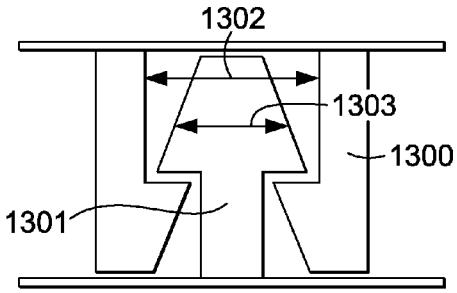
FIG. 13A-B is an illustration of a fastened male component and female component.
Figure 13B:
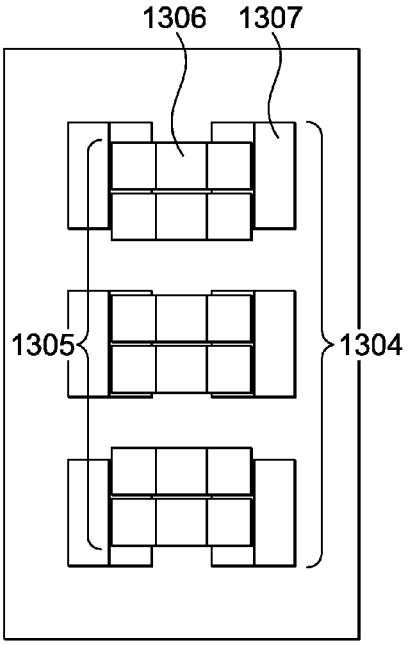

FIG. 13A-B illustrates another example of a track snap closure with the male component or track and the female component or track assembled. FIG. 13A-B illustrates a male component similar to FIG. 5 and a female component similar to FIG. 2. In the configuration illustrated in FIG. 13B, the female component 1304 may be notched into individual female projections 1307 and the male component 1305 may be notched into male projections 1306. As shown in FIG. 13A, the receiving area 1302 of the female component 1300 and the locking component 1303 of the male component 1301 fit together or snap together. The two tracks may be fastened either by snapping the male component 1305 into the female component 1304 or snapping a male projection 1306 into a female projection 1307. As illustrated in FIG. 13B, perfect registration of one male projection 1306 to one female projection 1307 may not be necessary for the closure to function. There does not have to be an equal number of male projections and female projections. Nor do the male projections and female projection have to be perfectly aligned with each other. Nor do the rails of the male component and the female component have to be the same length. However, in one example, there may be a ratio of one male projection to one female projection. The dual notches in the male component and the female component provide additional flexibility to the track snap closure, which allows for the track snap closure to be made from more rigid and durable materials if desired while preserving comfort and movement.

Figure 14A:
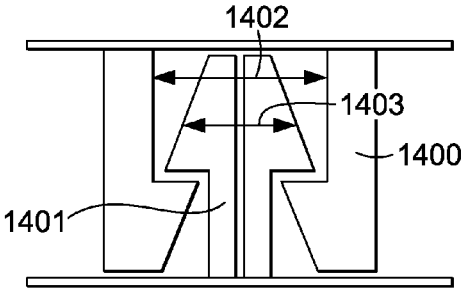
FIG. 14A-B is an illustration of a fastened male component and female component.
Figure 14B:
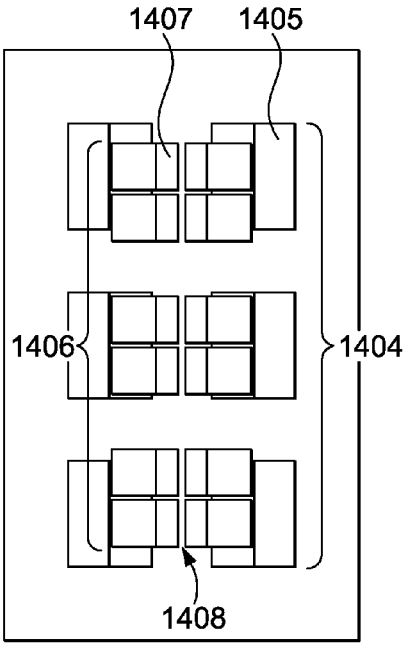

FIG. 14A-B illustrates another example of a track snap closure with the male component or track and the female component or track assembled. FIG. 14A-B illustrates a male component similar to FIG. 6 and a female component similar to FIG. 2. In the configuration illustrated in FIG. 14B, the female component 1404 may be notched into individual female projections 1405 and the male component 1406 may be notched into male projections 1407. The male component 1406 may be also notched 1408 along the length of the component, perpendicular to notches forming the male projections 1407. As shown in FIG. 14A, the receiving area 1402 of the female component 1400 and the locking component 1403 of the male component 1401 fit together or snap together. The two tracks may be fastened either by snapping the male component 1406 into the female component 1404 or snapping a male projection 1407 into a female projection 1405. As illustrated in FIG. 14B, perfect registration of one male projection to one female projection may not be necessary for the closure to function. Nor do the male projections and female projection have to be perfectly aligned with each other. The notch dividing the locking portion of the male component may provide some "give" to the male component provide easier snap closure. The dual notches in the male component and the female component provide additional flexibility to the track snap closure, which allows for the track snap closure to be made from more rigid and durable materials if desired while preserving comfort and movement.

The track snap fastener may provide a durable and comfortable form of apparel closure. The track snap fastener may also be employed to hold together various seams, edges, or surfaces in non-apparel applications. The track snap fastener presents numerous advantages in that perfect registration of the male and female portion of the fastener may be unnecessary for closure or fastening. Moreover, as the surfaces of the locking and receiving portions of the fastener may be textured or toothed, the track snap fastener may provide a secure closure with and without registration of the male and female components. The edges of the male component or female component may be raised to form a physical lock or barrier. Having a smooth locking and receiving surface may provide the fastener with a sliding fastening mechanism as well as a snap fastening mechanism.

Each portion or part of the fastener may be integrally formed or separately formed and assembled or any combination thereof. Different portions of the fastener or closure may be constructed of different materials. The fastener or closure may be molded of or machined from one material. For example, the fastener flanges may be formed of one polymer selected for flexibility and fusability with a garment and the rails and/or projections may be formed of one or more additional polymers selected for durability. In another example, the entire closure may be injection molded. Furthermore, a track snap closure may be molded or machined from any appropriate materials, including polyoxymethylene (e.g. Delrin™), polyethylene, polyvinylchloride, aluminum alloys, brass, and nickel alloys, nylon, aramids, etc. The assembled fastener may be affixed to clothing or other apparel items such as shoes, hats, gloves, etc. by fusing, sewing, gluing, or any other means.

Figure 15:
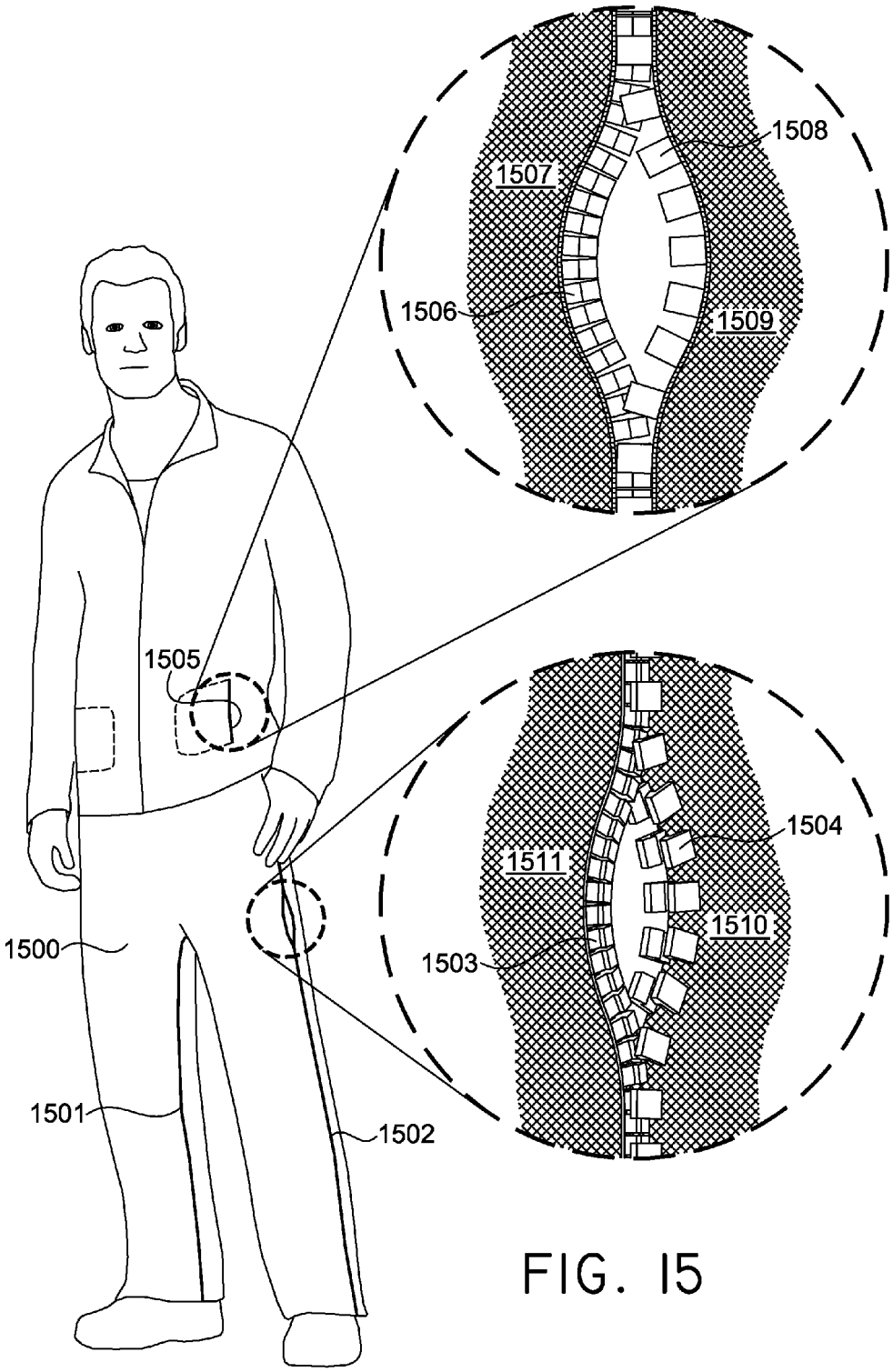
FIG. 15 is an illustration of apparel employing a track snap closure in various locations.

The track snap closure may be useful for a number of apparel applications. Generally, a track snap closure may be employed in any location a conventional fastening device is used. However, a track snap closure has benefits that conventional fastening devices cannot offer. FIG. 15 illustrates two examples of applications for track snap closures. For example, a track snap closure may be incorporated into "tear-away" clothing, such as exercise/warm-up pants. The track snap closure may be used on either the inner 1501 or outer seam 1502 or both of a pair of warm-up pants 1500. For example, one track snap component 1503 may be attached to the one side 1511 of the seam area and the complementary component 1504 may be attached to the opposite side 1510 of the seam area. The track snap closure may be used to seal portions of the seam while leaving portions open for ventilation according to the wearer's needs. The slide-ability of the male and female track of the track snap closure provides a pair of pants that have "tear away" capability and may refrain from bunching or snagging as may occur with traditional snaps or buttons.

In another example, one or more track snap closures may be employed for pockets 1505 of garments, such as outerwear. For example, a pocket may be disposed on the outside of an outwear garment. One track snap component 1506 may be attached to the outer surface 1507 of the outwear garment and the complementary component 1508 may be attached to the inner surface 1509 of the pocket. For a pocket inserted into a garment, the track snap components may be deployed on opposite seams of the pocket. The pocket may lay flat when closed via the track snap closure and may be easy to open and close. By way of further example, a track snap closure may be employed as the fly closure mechanism in a pair of pants or shorts. In another example, the track snap closure may be used to align multi-layered garments, such as a water-resistant shell and insulating liner. The inner surface of the water-resistant shell may be provided with one component (i.e. male or female) and the outer surface of an insulating liner may be provided with a complementary component. The track snap closure will provide fast and simple locking of the shell to the liner but the slide-ability of the track snap closure may also allow the user to align the shell and liner after locking rather than requiring perfect alignment while locking used in typical multi-layered garments.

Figure 16A:
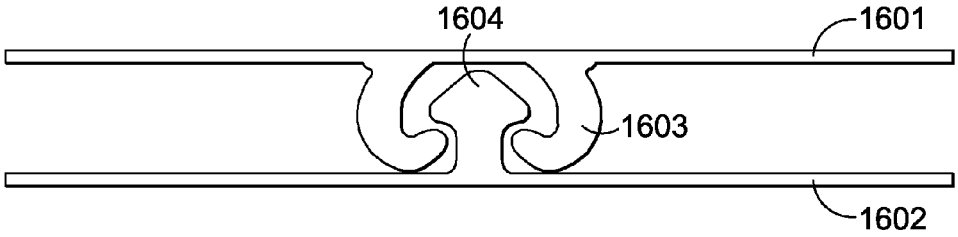
FIGS. 16A-D are illustrations of additional closure or fastener profiles.
Figure 16B:
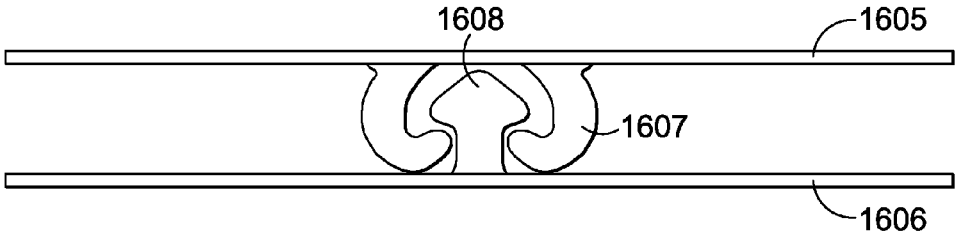
Figure 16C:
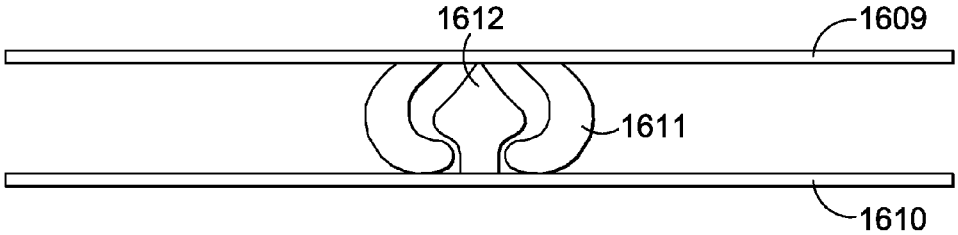
Figure 16D:
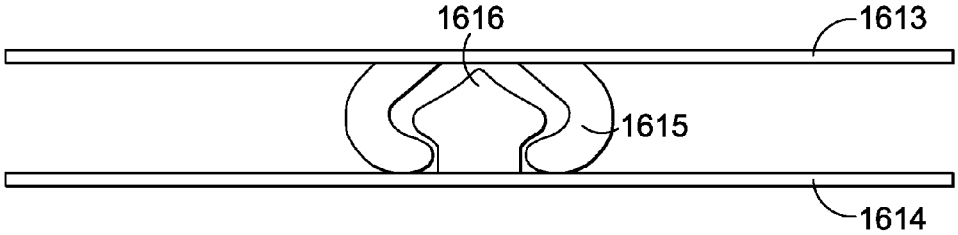

Additional, non-limiting, examples of geometries or profiles of track snap closures or fasteners are illustrated in FIGS. 16A-D. The male component and female component may also include any of the notched or segmented configurations described above. FIG. 16A illustrates a first flange 1602 attached to a male projection 1604 and a second flange 1601 attached to a pair of female projections 1603. The hooked portion of the female component may have a slightly rounded profile, while the locking portion of the male component may also have rounded edges and a flatter head area. FIG. 16B illustrates a first flange 1606 attached to a male projections 1608 and a second flange 1605 attached to a pair of female projections 1607. Alternately, the locking portion of the male component may have a rounded head area. In. FIG. 16C, a second flange 1609 is attached to a pair of female projections 1611, and a first flange 1610 is attached to a male projection 1612. The locking portion of the male component may have a tear-drop like profile. In FIG. 16D, the stem area of the projection of the male component 1616 attached to a first flange 1614 may be wider, such that the width of the stem may be greater than the overhanging portion of the locking portion area. The projections of the female component 1615 attached to a second flange 1613 may include a wider receiving area to accommodate this profile.

Figure 17A:
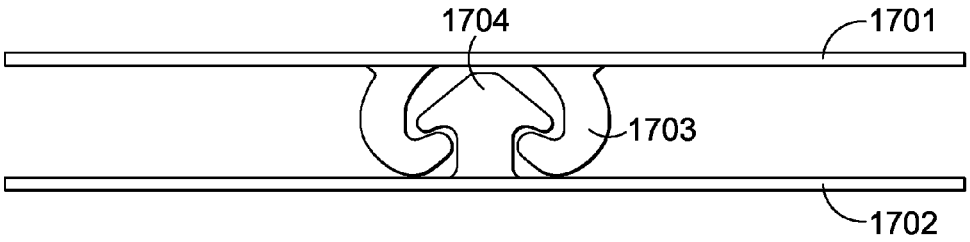
FIGS. 17A-D are illustrations of additional closure of fastener profiles.
Figure 17B:
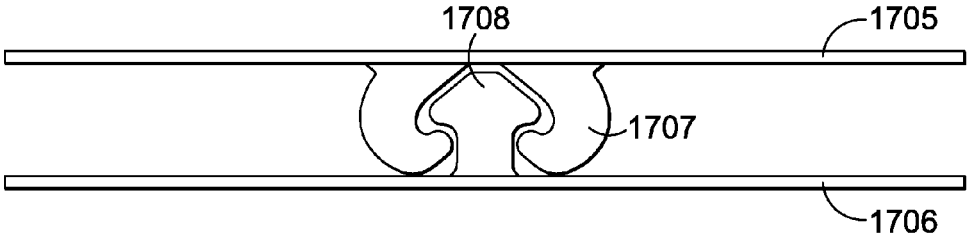
Figure 17C:
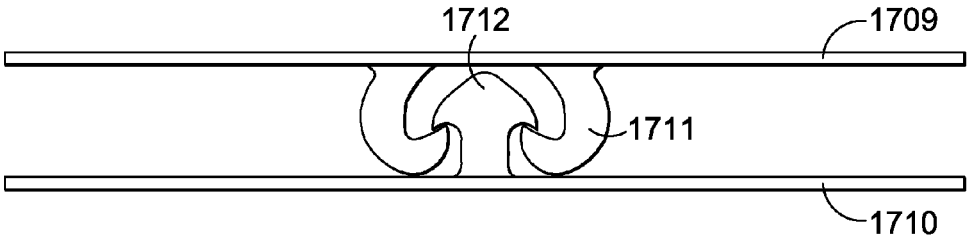
Figure 17D:
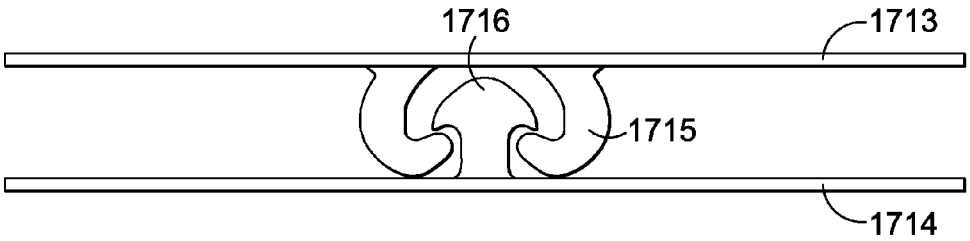

Further non-limiting examples of geometries or profiles of track snap closures or fasteners are illustrated in FIGS. 17A-D. The male components and female components illustrated in FIGS. 17A-D may include any of the notched configurations described above. FIG. 17A illustrates a first flange 1702 attached to a male component projection 1704 and a second flange 1701 attached to female component projections 1703. The female component may have a slightly rounded profile, while the locking portion of the male component may also have a larger overhang extending beyond the stem. This overhanging region of the locking portion may also be notched inwards to receive a portion of the female component that curves to fit the notched area. FIG. 17B illustrates a first flange 1706 attached to a male component projection 1708 and a second flange 1705 attached to a pair of female component projections 1707. The receiving area of the female component may be cut or molded to fit the geometry of the locking portion of the male component conformably or snugly. In FIG. 17C, a second flange 1709 is attached to female component projections 1711, which may include hooked portions that are more pointed and hooked to lock with locking portion of the male component 1711. The first flange 1710 is attached to a male component projection 1712 having a locking portion that may also include a hooked overhang region that locks with the hooked portion of the female component 1711. In addition, the head of the locking portion of the male component may be pointed or tapered for insertion into the receiving area. In FIG. 17D, the locking portion of the male component projection 1716 attached to a first flange 1714 includes the pointed overhang region and may have a rounder profile than FIG. 17C. The female component projections 1715 attached to a second flange 1713 may have rounded hooked portions.

The foregoing description of the embodiments may have been provided for purposes of illustration and description. It is not intended to be exhaustive or to limit the invention. Individual elements or features of a particular embodiment are generally not limited to that particular embodiment, but, where applicable, are interchangeable and may be used in a selected embodiment, even if not specifically shown or described.

What is claimed is:

1. A closure comprising:

a male component comprising a first flange and a plurality of male projections arranged along a first line, each male projection comprising a stem having a first base and a first head, connecting with the flange at the first base of the stem, and a locking portion, having a second base and a second head, the second base being wider than the stem and the second head, connecting with the first head at the second base, each male projection having a notch along the first line extending from the second head of the locking portion through the stem to the first base; and a female component comprising a second flange and a plurality of female projections arranged along a second line, each female projection comprising a first female stem and a second female stem arranged on opposite sides of the second line forming a receiving area to fit the locking portion, the first female stem further comprising a first hooked portion and the second female stem comprising a second hooked portion, the first hooked portion and the second hooked portion facing each other to fit the locking portion.

2. The closure of claim 1, the plurality of male projections of the male component being hooked at the second base of the locking portion to fit the receiving area.

3. The closure of claim 1, wherein the receiving area further comprises an inner surface and the locking portion further comprises an outer surface having a texture that grips the inner surface of the receiving area.

4. The closure of claim 1, wherein the locking portion further comprises an outer surface and the receiving area further comprises an inner surface having a texture that grips the outer surface of the locking portion.

5. The closure of claim 1, wherein the locking portion further comprises an outer surface and the receiving area comprises an inner surface which are substantially smooth such that when the locking portion is within the receiving area, the male component and the female component may slide while fastened.

6. A fastener comprising:

a male component comprising a first flange and a plurality of projections arranged along a first line, each projection comprising a stem having a first base and a first head, connecting with the flange at the first base of the stem, and a locking portion, having a second base and a second head, the second base being wider than the stem and the second head, connecting with the first head at the second base, each projection having a notch along the first line extending from the second head of the locking portion through the stem to the first base; and a female component comprising a second flange and a pair of rails comprising a first rail and a second rail arranged on opposite sides of a second line, the pair of rails each having a hooked portion extending towards each other forming a receiving area for the locking portion of the male component.

7. The fastener of claim 6, the pair of rails of the female component further comprising a plurality of notches through the pair of rails to the second flange and perpendicular to the second line.

8. The fastener of claim 7, the plurality of projections of the male component further comprising a notch in each male projection along the first line extending from the second head of the locking portion through the stem to the first base.

9. The fastener of claim 7, wherein the locking portion further comprises an outer surface and the receiving area comprises an inner surface, the outer surface and the inner surface are substantially smooth such that when the locking portion is within the receiving area, the male component and the female component may slide while fastened.

10. The fastener of claim 6, wherein the locking portion further comprises an outer surface and the receiving area further comprises an inner surface having a texture that grips the outer surface of the locking portion.

11. The fastener of claim 6, wherein the receiving area further comprises an inner surface and the locking portion further comprises an outer surface having a texture that grips the inner surface of the receiving area.

12. A fastener comprising:

a male track comprising a first flange and a first rail arranged along a first line, the first rail extending substantially the length of the first line and having a first base and a first head, connecting with the flange at the first base of the first rail, the first rail having a plurality of first notches perpendicular to the first line and through the first rail to the first flange and a plurality of second notches perpendicular to the first notches, along the first line, and through the first rail to the first flange, and a locking portion, having a second base and a second head, the second base being wider than the first base and the second head, connecting with the first head at the second base; and a female track comprising a second flange and a pair of rails comprising a second rail and a third rail arranged on opposite sides of a second line, the pair of rails having a pair of hooked projections extending towards each other forming a receiving area for the locking portion of the first rail.

13. The fastener of claim 12, the pair of rails of the female flange further comprising a plurality of notches perpendicular to the second line and through the pair of rails to the second flange.

14. The fastener of claim 12, the pair of rails of the female track further comprising a plurality of notches perpendicular to the second line and through the pair of rails to the second flange.

15. The fastener of claim 12, the first rail of the male track further comprising a hooked portion of the second base to fit the receiving area of the female track.

16. The fastener of claim 12, wherein the receiving area further comprises an inner surface and the locking portion further comprises an outer surface having a texture that grips the inner surface of the receiving area.

17. The fastener of claim 12, wherein the locking portion further comprises an outer surface and the receiving area further comprises an inner surface having a texture that grips the outer surface of the locking portion.

18. The fastener of claim 12, wherein the locking portion further comprises an outer surface and the receiving area comprises an inner surface, the outer surface and the inner surface are substantially smooth such that when the locking portion is within the receiving area, the male track and the female track may slide while fastened.

* * * * *